US012116866B2

(12) United States Patent
Louden et al.

(10) Patent No.: US 12,116,866 B2
(45) Date of Patent: Oct. 15, 2024

(54) DOWNHOLE RETAINER

(71) Applicant: ISOL8 (HOLDINGS) LIMITED, Aberdeen (GB)

(72) Inventors: Andrew Louden, Aberdeen (GB); Niall Lipp, Avoch (GB)

(73) Assignee: ISOL8 (HOLDINGS) LIMITED, Aberdeen (GB)

( * ) Notice: Subject to any disclaimer, the term of this patent is extended or adjusted under 35 U.S.C. 154(b) by 190 days.

(21) Appl. No.: 17/637,672

(22) PCT Filed: Sep. 2, 2020

(86) PCT No.: PCT/EP2020/025396
§ 371 (c)(1),
(2) Date: Feb. 23, 2022

(87) PCT Pub. No.: WO2021/043443
PCT Pub. Date: Mar. 11, 2021

(65) Prior Publication Data

US 2022/0275706 A1 Sep. 1, 2022

(30) Foreign Application Priority Data

Sep. 2, 2019 (GB) ..... 1912569

(51) Int. Cl.
*E21B 36/00* (2006.01)
*E21B 33/12* (2006.01)
(Continued)

(52) U.S. Cl.
CPC ..... *E21B 36/008* (2013.01); *E21B 33/1208* (2013.01); *E21B 33/128* (2013.01); *E21B 33/1293* (2013.01)

(58) Field of Classification Search
CPC .. E21B 36/008; E21B 33/128; E21B 33/1293; E21B 33/13
See application file for complete search history.

(56) References Cited

U.S. PATENT DOCUMENTS 2,969,839 A 1/1961 Greene
3,487,161 A * 12/1969 James ..... H01R 43/0422 439/879

(Continued)

FOREIGN PATENT DOCUMENTS

CN 2406059 Y 11/2000
GB 2568519 A 5/2019
WO 01/92681 A1 12/2001

OTHER PUBLICATIONS

International Search Report and Written Opinion for Int. App. No. PCT/EP2020/025396, mailed Feb. 8, 2021.
GB Search Report for App. No. GB1912569.9, dated Sep. 19, 2019.

*Primary Examiner* — D. Andrews
*Assistant Examiner* — Ronald R Runyan
(74) *Attorney, Agent, or Firm* — MCDONNELL BOEHNEN HULBERT & BERGHOFF LLP

(57) ABSTRACT

A method of retaining material in a bore comprises running a tool comprising a retainer member and a fusible part into a bore with the retainer member in a retracted configuration. The tool is positioned at a desired location in the bore and the fusible part is heated to reconfigure the retainer member to an extended configuration in which the retainer member engages the bore wall.

19 Claims, 2 Drawing Sheets

(51) Int. Cl.
*E21B 33/128* (2006.01)
*E21B 33/129* (2006.01)

(56) References Cited

U.S. PATENT DOCUMENTS

| | | | | |
|---|---|---|---|---|
| 4,523,640 | A * | 6/1985 | Wilson | E21B 36/00 166/241.5 |
| 4,960,173 | A | 10/1990 | Cognevich et al. | |
| 5,613,557 | A * | 3/1997 | Blount | E21B 23/06 166/299 |
| 6,382,234 | B1 | 5/2002 | Birckhead et al. | |
| 2015/0101813 | A1 | 4/2015 | Zhao et al. | |
| 2019/0078406 | A1 * | 3/2019 | Scruggs | E21B 23/042 |
| 2019/0128091 | A1 | 5/2019 | Carragher | |

* cited by examiner

DOWNHOLE RETAINER

CROSS REFERENCE TO RELATED APPLICATIONS

The present application is a U.S. National Phase Application pursuant to 35 U.S.C. § 371 of International Application No. PCT/EP2020/025396 filed Sep. 2, 2020, which claims priority to GB Patent Application No. 1912569.9 filed Sep. 2, 2019. The entire disclosure contents of these applications are herewith incorporated by reference into the present application.

FIELD

This disclosure relates to a downhole retainer, and to an apparatus and method for retaining a material in a downhole environment. The material may be cement or sand. Alternatively, the material may be a molten material. The retainer setting may be initiated by applying heat to a fusible part.

BACKGROUND

There have been numerous proposals for sealing or plugging of abandoned oil and gas wells using cement and fusible materials. In the fusible material proposals an alloy, which may be a low melt point alloy such as bismuth/tin (Bi/Sn), is fluidised and permitted to flow and fill bore-lining tubing. The molten alloy is permitted to cool to create a solid plug which is bonded to the surface of the tubing.

Numerous proposals have suggested that an alloy such as bismuth/tin (Bi/Sn) would be suitable to form such a plug. Bi/Sn alloy is relatively dense and is very mobile in the molten state. Accordingly, it can be challenging to retain molten Bi/Sn alloy in a desired location while the alloy freezes to form a sealing plug or barrier.

SUMMARY

According to a first aspect of the disclosure there is provided a method of retaining a material in a bore, the method comprising:

running a tool comprising a retainer member and a fusible part into a bore with the retainer member in a retracted configuration;

locating the tool at a desired location in the bore, and heating the fusible part such that the retracted retaining member is reconfigured to an extended configuration in which the retainer member engages the bore wall.

According to a second aspect of the disclosure there is provided downhole apparatus comprising:

a body;

a retainer member mounted on the body, the retainer member having an initial retracted configuration and an extended configuration in which the retainer member extends radially from the body, and a fusible part, whereby heating of the fusible part permits reconfiguration of the retainer member from the retracted configuration to the extended configuration.

According to a third aspect of the disclosure there is provided a downhole method comprising:

running apparatus comprising at least one grip and a fusible part into a bore with the at least one grip in a retracted configuration, and heating the fusible part and reconfiguring the grip to an extended configuration in which the grip engages the bore wall.

According to a fourth aspect of the disclosure there is provided a downhole apparatus comprising:

a body;

at least one grip mounted on the body, the grip having an initial retracted configuration and an extended configuration in which the grip extends radially from the body, and a fusible part for the grip, whereby heating of the fusible part permits reconfiguring of the grip from the retracted configuration to the extended configuration.

A downhole apparatus may include the retainer member of the second aspect and the grip of the fourth aspect. The apparatus may include a common fusible part for the retainer member and the grip. The apparatus may form part of a larger tool or apparatus, for example apparatus for use in plugging or sealing a bore.

The fusible part may comprise a fusible material, for example an alloy or polymeric member. The member may initially be solid and in the solid condition may maintain at least one of the retainer members and the grip in the retracted configuration. On melting or softening the fusible part may permit the retainer member or the grip to move to the extended configuration. On melting the fusible part may permit release of stored energy, for example in a compressed spring or atmospheric chamber, to reconfigure the retainer member or grip. In the solid condition the fusible part may be subject to a force, for example compression, tension or shear, and on melting the fusible part may fail, yield or turn to a liquid.

The apparatus may be provided in combination with a heater. The heater may be provided solely to activate or modify the fusible part or may serve additional functions. The heater may be utilised to fluidise, ignite or melt other material, such as resins, polymers, thermite or a seal-forming material. In one example the heater is an exothermic heater, such as a thermite heater, or may be an initiator for a thermite heater.

According to a further aspect of the invention there is provided downhole retaining apparatus comprising:

a body; and a retainer member mounted on the body, the retainer member comprising a deformable disc and having an initial retracted configuration and an extended configuration in which the retainer member extends radially from the body, in the initial retracted configuration the retainer member being elastically deformed and radially restrained, whereby on removal of the radial restraint the retainer member extends radially.

The retainer member may be configured to form a seal against the wellbore when unrestrained.

According to a still further aspect of the disclosure there is provided a downhole material retaining method comprising:

elastically deforming a disc of a first diameter to describe a smaller second diameter and restraining the disc at the second diameter;

running the disc into a bore; and releasing the disc to describe a third diameter larger than the second diameter such that the disc engages an inner wall of the bore.

The extended disc may be used to retain a material above the disc.

The disc may be restrained by a sleeve, ring or band. The disc may be released by relative axial movement of the disc and sleeve. In another example the sleeve may extend or separate to release the disc. In one example the sleeve encloses and restrains the disc and thus may protect the disc until the disc is released.

When describing the third diameter portions of the disc may be arranged at an acute angle to the bore wall, so that the disc forms a cup which may seal.

The disc may include multiple layers of material. The layers of material may be formed of the same or different materials; the disc may include metallic elements or may include polymeric elements.

The disc may include multiple radially extending slots. The disc may include multiple slotted layers of material and the slots of adjacent layers may be offset.

The disc may include multiple radially extending fold lines and the deformation may be concentrated at the fold lines.

The disc may be formed of any suitable material or combination of materials.

According to an alternative aspect of the disclosure there is provided a releasable downhole coupling comprising an elongate support member having an end portion anchored by a fusible coupling, whereby heating of the coupling releases the end portion of the elongate support member.

At least the end portion of the elongate support member may comprise multiple strands. The fusible coupling may comprise a socket, such as a spelter socket, and the multiple strands of the elongate support member may be anchored in the socket by a fusible material, whereby melting of the fusible material allows the strands to be withdrawn from the socket. In other examples other components of a socket or anchor may be formed of fusible material.

The elongate support member may comprise a cable, rod or tube. The fusible coupling may be provided separately of the support member or may be a part or portion of the member. For example, the support member may be adapted to be severed or otherwise fail on heating.

The fusible coupling may directly anchor the elongate support member or may cooperate with or be operatively associated with an anchoring arrangement, such as teeth or dogs. On heating the coupling may permit the teeth or dogs to retract or otherwise reconfigure to release the support member.

The elongate support member may be in tension, such that on its release the end portion is translated due to contraction of the support member. The tension of the support member may be utilised to maintain elements of a tool in compression, for example the compression may be utilised to maintain the structural integrity of a plurality of inter-engaging tool elements.

The elongate support member may include one or more electrical conductors. In one example the elongate support member is utilised to supply electrical energy to an electric heater or to one or more initiators for an exothermic heater, such as a thermite heater.

The end portion of the elongate support anchored by the fusible coupling may be a lower end portion.

The elongate support member may extend from an upper portion of a tool and may support a lower part of the tool, whereby on heating of the fusible coupling the lower part of the tool may separate from the upper part of the tool.

The various features described above, and in the claims below, may have utility in combination with the aspects of the disclosure described above, and may also have utility independently of these aspects. The features may also be combined with selected individual features of the illustrated examples.

BRIEF DESCRIPTION OF THE DRAWINGS

Examples of the disclosure will now be described, by way of example, with reference to the accompanying drawings, in which.

DETAILED DESCRIPTION

Figure 1:
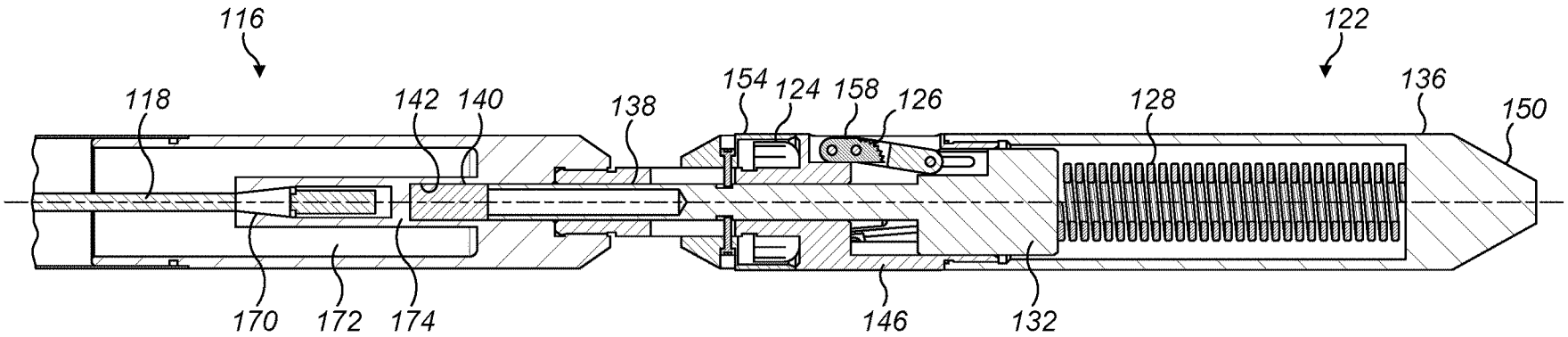
FIGS. 1 & 2 are sectional views of a downhole material retainer.
Figure 2:
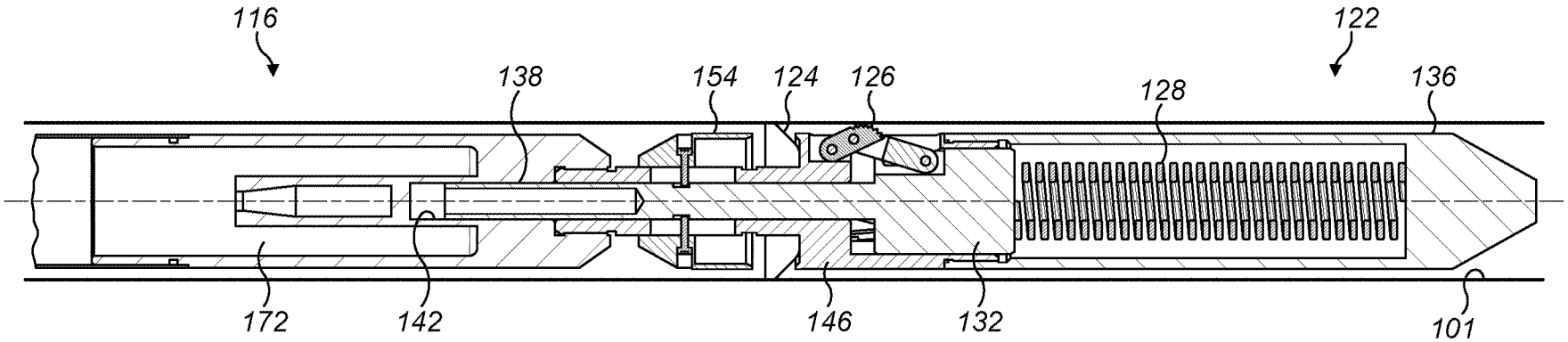

Reference is made to FIGS. 1 & 2, and FIGS. 3*a*, 3*b* & 3*c*, which show a downhole material retainer 122. FIG. 1 illustrates the retainer 122 in a first configuration, with a retainer or sealing disc 124 and bore wall grips/slips 126 retracted. FIG. 2 illustrates the retainer 122 in an activated configuration, with the sealing disc 124 and the slips 126 radially extended.

The retainer 122 includes an axially extending coil spring 128 which is initially compressed to provide stored energy to activate the retainer 122. The spring 128 abuts an anchor piston 132. The lower end of the spring 128 engages a bottom sub 136. The anchor piston 132 is coupled to an upper mandrel 138 upper end portion 140. The upper mandrel 138 is formed of a suitable material, such as steel, while the mandrel upper end portion 140 is formed of an alloy, metal or other material having a significantly lower melt point than steel.

A bullnose 150 is mounted on the lower end of the bottom sub 136.

The retainer disc 124 is mounted on the upper body 146 and is retained on the body by an axial support. In the first configuration, as illustrated in FIG. 1, the retaining disc 124 is restrained in a deformed retracted configuration by a retainer sleeve 154 which extends over the retaining disc 124.

The slips 126 are also mounted on the upper body 146 and are provided on slip arms 158 pinned to the body 146 such that the slips 126 may be pivoted out to engage the surrounding steel tubing 101. The movement of each slip arm 158 is driven by the anchor piston 132, which is powered by the spring 128.

Activation of a heater 116 (discussed in greater detail below), generates elevated temperatures and fluidises the alloy upper end portion 140 of the mandrel 138. As the mandrel 138 is in compression from the action of the spring 128, on melting the fluidised alloy mandrel portion 140 collapses and allows the spring 128 to move the anchor piston 132 and the upper mandrel 138 upwards relative to the upper body 146.

The movement of the upper mandrel 138 relative to the upper body 146 releases the retaining disc 124 from the disc retainer 154, such that the disc 124 is free to extend and engage the surrounding tubing 101. However, the disc 124 is prevented from fully extending by contact with the tubing 101 and is restrained to extend at an acute angle from the body 146, forming a cup-like form. Similarly, the slip arms 158 are pivoted outwards to engage the slips 126 with the tubing 101.

Figure 3C:
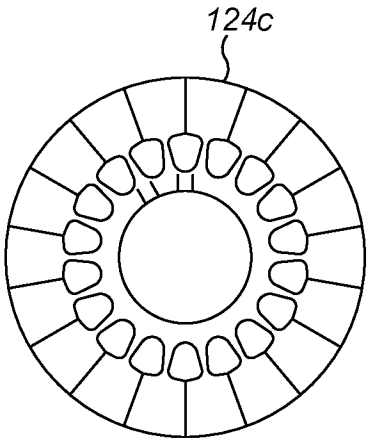
FIGS. 3*a*, 3*b* & 3*c* show alternative metal sealing discs for the retainer of FIGS. 1 & 2.
Figure 3B:
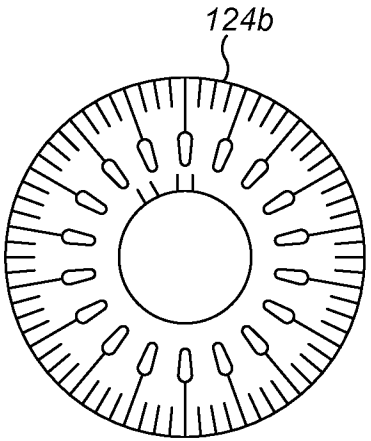
Figure 3A:
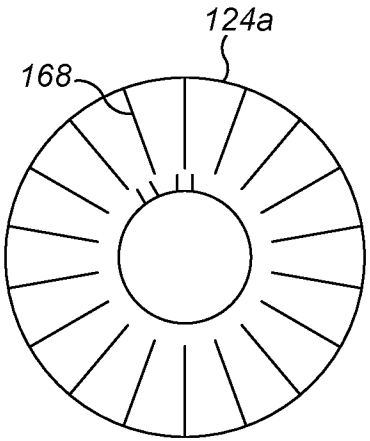

FIGS. 3*a*, 3*b* & 3*c* illustrate different forms of retaining disc 124*a*, 124*b*, 124*c*. The discs are formed of thin metal or other deformable material, such as molybdenum foil, plastic, felt, steel or the like. The discs include radial cuts 168 such that the discs comprise multiple petals, which facilitates the deformation of the discs 124*a-c* to the retracted configuration without the discs 124*a-c* experiencing plastic deformation, that is the discs 124*a-c* are deformed elastically.

A single disc 124 may be provided in the retainer 122, or multiple discs 124 of the same or different materials may be provided to create a laminate structure.

FIGS. 1 & 2 also illustrate the heater 116 and a cable anchor 170. The heater defines an annular form around a central body portion 174 defining the chamber 142 which accommodates and restrains the alloy mandrel upper end portion 140. The heater module 172 may comprise a thermite mix and contain an electrical initiation means which is powered by ignition wire which runs through the support cable 118.

The cable 118 may be tensioned to facilitate a connection with an adjacent tool string component. The lower end of the cable 118 is fixed in the cable anchor/socket 170, which is formed of fusible alloy. The socket 170 is secured in the body portion 174. The cable 118 extends upwards from the socket 170 to the adjacent tool string component.

When power is supplied to the heater 116 the heating elements (electric or exothermic) in the module 172 heats and fluidises the alloy mandrel upper end portion 140, thus activating the retainer 122. The retaining disc 124 extends from the retainer 122 to engage and seal with the tubing 101 and the slips 126 also extend to grip the tubing 101. As the heat moves upwards, the cable socket 170 is also heated and soon melts to release the lower end of the cable 118. As the cable 118 was in tension, on release of the cable 118 from the socket 170 the lower end of the cable 118 is pulled upwards releasing the retainer 122 from the adjacent tool string component. Further, as the slips 126 have been extended to engage the tubing 101 and the rope socket 170 has melted, the cable 118 now no longer supports the retainer 122 and the heater 116, which significantly reduces the load being suspended from the wireline. Thus, the wireline will axially contract, separating the tool above the heater.

In certain tool string configurations cement, or another material, may now be bailed on top of the retainer 122. In other tool string configurations thermite and/or alloy may be deposited on the retainer 122. This may be performed immediately following the setting of the retainer 122. The molten material, under the influence of gravity, will tend to flow downwards and accumulate above the retainer 122. The characteristics of the molten thermite reaction products may be adjusted by controlling the elements of the initial thermite mix, and in one example the thermite is formulated to fluidise and flow downwards. The molten alloy may form a seal above the thermite and may fuse with and fill voids in and around the thermite reaction products. The molten alloy may continue to flow downwards until the alloy encounters the extended retainer disc 124. The thermite and alloy will thus be retained above the disc 124 and will settle in the tubing 101 to fill the volume above the disc 124. The dense alloy will displace any well fluid and will occupy any voids or spaces in the thermite reaction products and in the elements of the upper part of the retainer 122 and the heater 116 which are not melted.

In other examples of the disclosure alternative or additional fusible members or elements may be provided. For example, a shear coupling comprising fusible material may be provided and may initially fix two parts relative to one another. On heating, the coupling, which may take the form of a pin, may fail and permit relative movement of the parts, and extension of a retaining disc or slips. In another example a retaining sleeve, ring or band comprising fusible material may encircle or otherwise restrain a retaining disc or slips which are biased to assume an extended configuration. On heating the fusible material may soften or flow and allow the disc or slips to extend, In one specific example the illustrated mandrel upper end portion 140 may be replaced by an aluminium shear pin which extends across the chamber 142 and restrains the upper end of the mandrel 138. On heating, the pin softens and shears, allowing the spring 128 to move the anchor piston 132 and the upper mandrel 138 upwards relative to the upper body 146. In other examples the shear pin may be formed of an alloy, for example brass. In another example a small cross section or hollow steel pin may be provided.

In the illustrated example a cable 118 is fixed in a fusible cable anchor/socket 170, which is secured in the body portion 174. In another examples the cable 118 is replaced by a rod or tube. In one example a steel tube with a threaded end engages a threaded anchor. On activation the adjacent heater creates liquid thermite, which severs and releases the end of the rod.

The invention claimed is:

1. A downhole method comprising:

providing an apparatus comprising a body, a member mounted to the body, and a member retaining arrangement including a fusible part having a melt point at which the fusible part softens, the member having an initial retracted configuration and an extended configuration in which the member extends radially outwards from the body, and the member retaining arrangement having an initial configuration with the fusible part in a solid form and a release configuration with the fusible part in a softened form, wherein in the initial configuration the member retaining arrangement maintains the member in the initial retracted configuration, and in the release configuration the member retaining arrangement permits the member to assume the extended configuration;

running the apparatus into a bore with the member maintained in the initial retracted configuration by the member retaining arrangement;

locating the apparatus at a desired location in the bore, and heating the fusible part to at least the melt point whereby the fusible part transforms at least partially from the solid form to the softened form, and the member retaining arrangement assumes the release configuration, thereby permitting reconfiguring of the member to the extended configuration in which the member extends radially outwards from the body and engages a wall of the bore;

wherein the member comprises a deformable disc of a first diameter and the method further comprises:

elastically deforming the disc from the first diameter to describe a smaller second diameter and restraining the disc at the second diameter;

running the disc into the bore; and releasing the disc to describe a third diameter larger than the second diameter and whereby the disc engages an inner wall of the bore.

2. The method of claim 1, wherein the member comprises at least one of a retainer member and a grip.

3. The method of claim 1, wherein the fusible part comprises an alloy and heating the fusible part fluidises the alloy.

4. The method of claim 1, wherein heating the fusible part permits release of stored energy and relative movement of elements of the member retaining arrangement.

5. The method of claim 1, comprising heating the fusible part with an exothermic heater.

6. The method of claim 1, wherein when describing the third diameter portions of the disc are arranged at an acute angle to the bore wall, so that the disc forms a cup shape.

7. A downhole apparatus comprising:

a body;

a member mounted on the body, the member having an initial retracted configuration and an extended configuration in which the member extends radially outwards from the body, and a member retaining arrangement including a fusible part having a melt point at which the fusible part softens, the member retaining arrangement having an initial configuration with the fusible part in a solid form and a release configuration with the fusible part at least partially in a softened form, wherein in the initial configuration the member retaining arrangement maintains the member in the initial retracted configuration and in the release configuration the member retaining arrangement permits the member to assume the extended configuration, whereby upon heating of the fusible part to at least the melt point, the fusible part transforms at least partially from the solid form to the softened form, and the member retaining arrangement assumes the release configuration, and whereby heating of the fusible part permits reconfiguration of the member from the retracted configuration to the extended configuration;

wherein the member comprises a retainer disc which is elastically deformed in the retracted configuration.

8. The apparatus of claim 7, wherein the member comprises at least one of a retaining member and a grip.

9. The apparatus of claim 7, wherein the fusible part comprises an alloy member.

10. The apparatus of claim 7, wherein the fusible part is initially in at least one of compression, tension and shear, and on heating at least one of melts, otherwise reforms and deforms to permit relative movement of elements of the member retaining arrangement.

11. The apparatus of claim 7, wherein on heating the fusible part permits release of stored energy to reconfigure the member.

12. The apparatus of claim 7, in combination with a heater.

13. The apparatus of claim 7, wherein the member comprises at least one slip.

14. The apparatus of claim 7, wherein the member comprises a deformable disc, in the initial retracted configuration the disc being elastically deformed and radially restrained, whereby on removal of the radial restraint the disc extends radially from the body.

15. The apparatus of claim 14, wherein the disc is restrained by a sleeve and is released by relative axial movement of the disc and sleeve.

16. The apparatus of claim 14, wherein the disc comprises multiple petals.

17. The apparatus of claim 14, wherein the member comprises a deformable metal disc.

18. The apparatus of claim 14, wherein the member comprises multiple deformable discs.

19. A downhole apparatus comprising:

a body;

a member mounted on the body, the member having an initial retracted configuration and an extended configuration in which the member extends radially outwards from the body, and a member retaining arrangement including a fusible part having a melt point at which the fusible part softens, the member retaining arrangement having an initial configuration with the fusible part in a solid form and a release configuration with the fusible part at least partially in a softened form, wherein in the initial configuration the member retaining arrangement maintains the member in the initial retracted configuration and in the release configuration the member retaining arrangement permits the member to assume the extended configuration, whereby upon heating of the fusible part to at least the melt point, the fusible part transforms at least partially from the solid form to the softened form, and the member retaining arrangement assumes the release configuration, and whereby heating of the fusible part permits reconfiguration of the member from the retracted configuration to the extended configuration;

wherein the member comprises a deformable disc, in the initial retracted configuration the disc being elastically deformed and radially restrained, whereby on removal of the radial restraint the disc extends radially from the body.

* * * * *